US007806129B2

(12) United States Patent
Jabbar

(10) Patent No.: US 7,806,129 B2
(45) Date of Patent: Oct. 5, 2010

(54) NAP PAINT ROLLER CLEANER

(76) Inventor: Abdal-Rahim Jabbar, 2550 Pennsylvania Ave., Beaumont, TX (US) 77701

( * ) Notice: Subject to any disclaimer, the term of this patent is extended or adjusted under 35 U.S.C. 154(b) by 1106 days.

(21) Appl. No.: 10/838,919

(22) Filed: May 4, 2004

(65) Prior Publication Data

US 2005/0247329 A1 Nov. 10, 2005

(51) Int. Cl.
*B08B 3/04* (2006.01)

(52) U.S. Cl. ..... 134/138; 134/900

(58) Field of Classification Search ..... 134/900, 134/138

See application file for complete search history.

(56) References Cited

U.S. PATENT DOCUMENTS 3,460,988 A * 8/1969 Dineen et al. ..... 134/1
3,472,251 A * 10/1969 Parker, Jr. ..... 134/138
3,650,283 A * 3/1972 Lang ..... 134/143
4,025,363 A * 5/1977 De Santis ..... 134/102.2
4,130,443 A * 12/1978 Dulin ..... 134/140
4,294,272 A * 10/1981 Klaiber ..... 134/138
4,446,590 A * 5/1984 Kirchner et al. ..... 15/302
4,448,209 A * 5/1984 Lindsay ..... 134/141
4,497,441 A * 2/1985 Chow ..... 239/230
4,785,836 A * 11/1988 Yamamoto ..... 134/56 R
4,815,486 A * 3/1989 Schinn ..... 134/111
4,832,066 A * 5/1989 Shipman ..... 134/137
4,960,142 A * 10/1990 Robb et al. ..... 134/138
5,005,598 A * 4/1991 Hodgdon ..... 134/138
5,097,967 A * 3/1992 Sica ..... 211/66
5,220,933 A * 6/1993 Albers ..... 134/58 R
5,363,869 A * 11/1994 McDowell ..... 134/104.2
5,409,027 A * 4/1995 Glunt ..... 134/138
5,413,133 A * 5/1995 Russell ..... 134/138
5,487,399 A * 1/1996 Hannah ..... 134/138
5,505,220 A * 4/1996 Gorecki ..... 134/138
5,641,007 A * 6/1997 Falk ..... 141/106
5,645,091 A * 7/1997 Hoeft ..... 134/84

(Continued)

*Primary Examiner*—Michael Cleveland
*Assistant Examiner*—Samuel A Waldbaum
(74) *Attorney, Agent, or Firm*—Delphine James

(57) ABSTRACT

The present invention is a device for cleaning a soiled paint roller. The device comprises a housing supported by at least two leg members. The housing includes an opened top, a plurality of sidewalls and a bottom wall. A spindle is interiorly mounted to the bottom wall of the container at a predetermined height, the spindle having means for circumferentially engaging the paint roller. An inlet port is mounted to a side wall and in fluid communication with a cleaning fluid source. At least one stationary sprayer is interiorly mounted to the bottom wall at a predetermined height and a predetermined distance from an end of the spindle. The at least one stationary sprayer is operationally coupled to the inlet port and is in fluid communication with the inlet port for providing a continuous stream of water directly onto the paint roller. At least one pivoting sprayer is interiorly mounted to the bottom portion at a predetermined height and a predetermined distance from the spindle. The at least one pivoting sprayer is in fluid communication with the inlet port for providing a continuous stream of water directly onto the paint roller. A control valve operationally connected to the inlet port. The control valve allows the user to selectively initiate and terminate the flow of cleaning fluid between the at least one stationary sprayer and the at least one pivoting sprayer. In an alternative embodiment, the device can be adapted with a reservoir for providing the cleaning fluid into the housing.

21 Claims, 7 Drawing Sheets

U.S. PATENT DOCUMENTS 5,816,275 A * 10/1998 Mullen ..... 134/141
5,839,459 A * 11/1998 Bisby ..... 134/138
5,935,342 A * 8/1999 Boyd ..... 134/33
6,408,862 B1 * 6/2002 van Rooyen ..... 134/138
2001/0047818 A1 * 12/2001 Bastien ..... 134/138
2002/0166578 A1 * 11/2002 Leblond ..... 134/99.2
2002/0179545 A1 * 12/2002 Rosenberger et al. ..... 210/806
2003/0177597 A1 * 9/2003 Wallace, III ..... 15/142
2004/0003835 A1 * 1/2004 Higgins ..... 134/138
2004/0149320 A1 * 8/2004 Hutchinson ..... 134/32

* cited by examiner

NAP PAINT ROLLER CLEANER

BACKGROUND

This invention relates to the removal of paint from paint rollers. Normally, paint is removed from paint rollers by immersing them in some type of solvent. For latex based paints, the paint roller is immersed in containers of water. For oil based paints, the paint roller is immersed in a solvent such as mineral spirits. The primary object of this invention is to provide a device that can efficiently clean paint rollers. A patent search was performed and several of the patents disclose an apparatus in which the paint roller is inserted into the housing for cleaning, for example, U.S. Pat. No. 3,886,960. However, none of the patents from the search taken singularly or in combination discloses the present invention to be described herein.

SUMMARY

The present invention provides a device for cleaning a soiled paint roller. In one embodiment, the device cleans a paint roller soiled with latex paint. In the alternative embodiment, the device cleans a paint roller soiled with oiled based paint. The device includes a housing having an inlet port connected to a garden water hose for supplying cleaning fluid into the housing. The housing further comprises a pivoting sprayer as well as at least one stationary sprayer interiorly mounted to the bottom wall. A spindle is mounted to the bottom wall for circumferentially engaging the soiled paint roller. As the soiled roller is cleaned, the excess fluid is allowed to escape through a drain hole. In the alternative embodiment to support oil based paint, a reservoir is connected to the drain hole to provide an alternative cleaning fluid into the housing.

DETAILED SPECIFICATION

Figure 1:
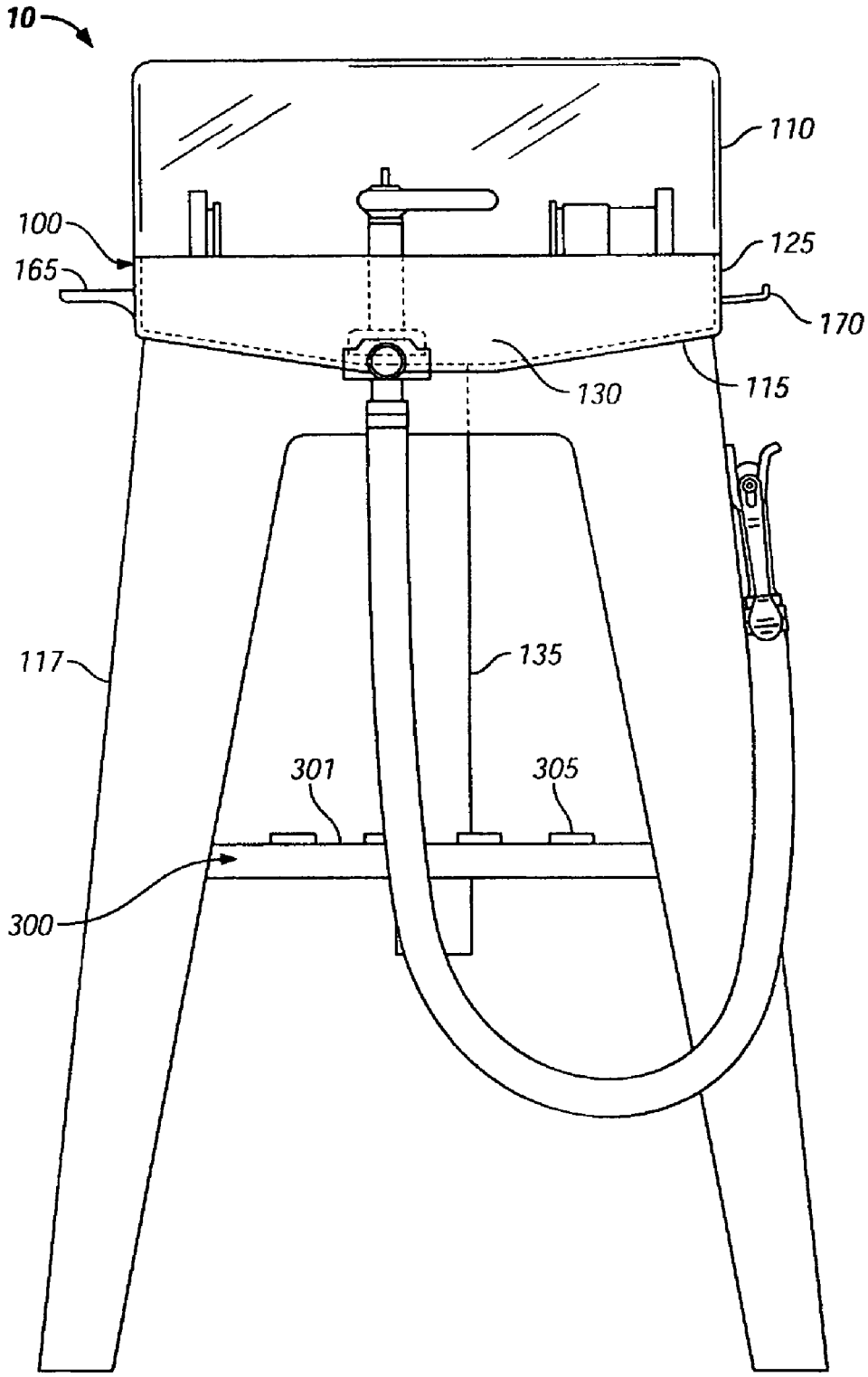
FIG. 1 illustrates a frontal side view of the present invention.

Referring to FIG. 1, there is shown one embodiment of the present invention, a device to clean a soiled paint roller. As illustrated, the present invention includes a housing (100) with an opened top. Housing (100) further includes a bottom wall (115) surrounded by a plurality of side walls (125) which extend vertically upward. The depicted housing (100) has a polygonal configuration. Housing (100) can be made of steel, aluminum, sturdy plastic or another suitable material.

Approximately near the center of bottom wall (115) is drain hole (130). Bottom wall (115) slopes inwardly at an incline from its outer peripheral edge to the drain hole (130). The inward incline of bottom wall (115) allows the fluid to quickly escape through drain hole (130). Drain hole (130) further includes an elongated pipe (135) projecting vertically downward. During the cleaning process of the soiled paint roller, the excess fluid escapes from housing (100) into drain hole (130) through pipe (135).

In the illustrated embodiment, four leg members (117) support housing (100). Bottom wall (115) is mounted upon the four leg members (117), which extend vertically downward therefrom. In some embodiments, the present invention can include a drying rack (300) mounted below elongated pipe (135) situated between leg members (117). Drying rack (300) has a flat planar surface (301) with a plurality of cylindrical shape studs (305). Each stud (305) extends vertically upward to a predetermined height and has means for circumferentially engaging one end of a cleaned paint roller. Thus, the circumference of each stud (305) has a slightly smaller circumference than each opened end of the paint roller. Having the slightly smaller circumference allows each opened end of a cleaned paint roller to slidably engage upon stud (305). Additionally, the height of each stud is sufficient to support the cleaned paint roller in a horizontal position (not shown).

Figure 2:
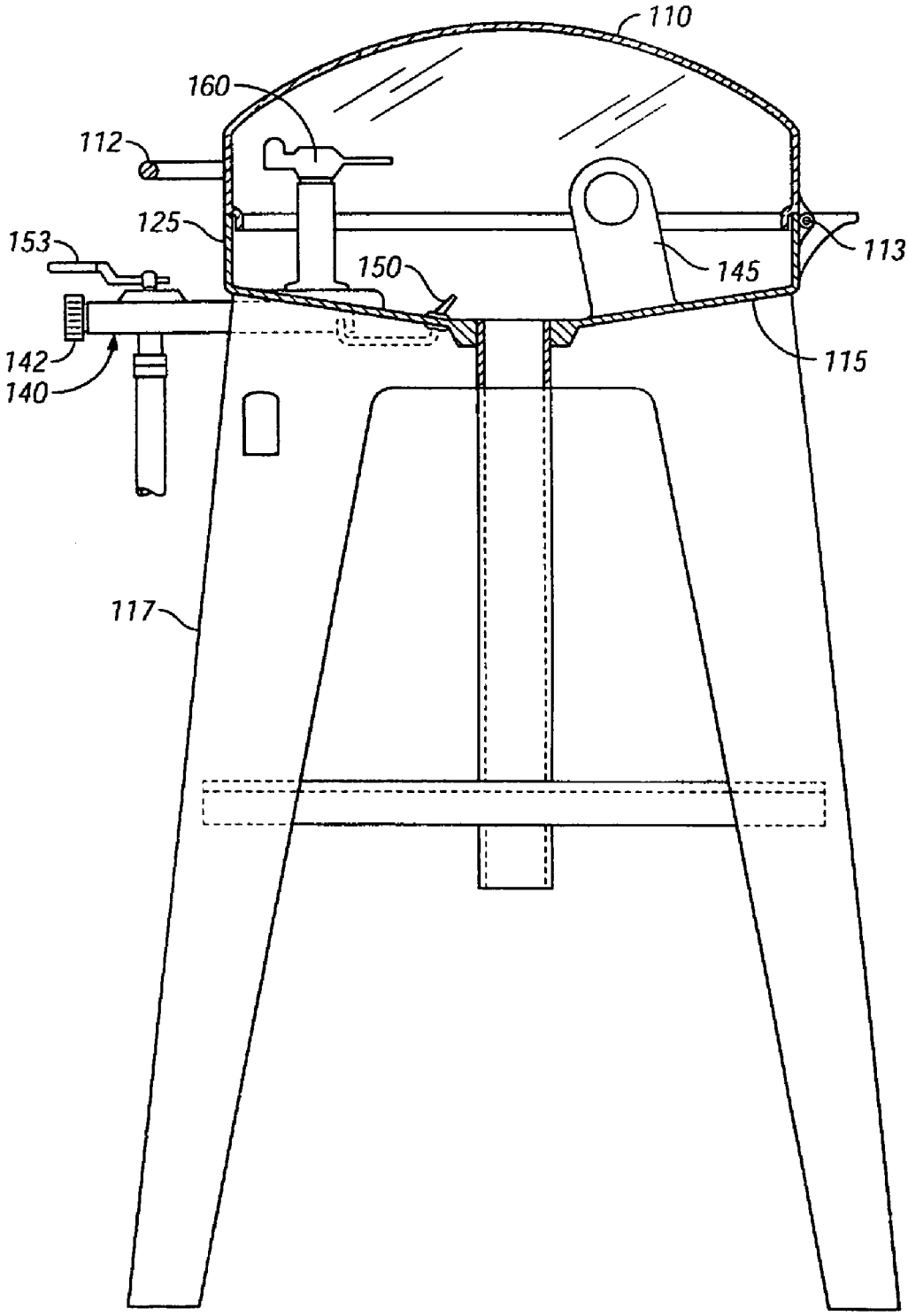
FIG. 2 illustrates a cross-sectional view of the present invention.

Referring to FIG. 2, the present invention can include cover (110) which is hingedly connected to the upper edge of one side wall (125). Hinge connection (113) allows the cover to transverse between an opened position and a closed position. The cover (110) can be made of a transparent material such as plexiglass or another suitable material. Additionally, as depicted, handle (112) can be mounted to the exterior surface of cover (110). Handle (112) assists the user to transverse the cover between an opened position and a closed position.

As illustrated in FIG. 2, the inlet port (140) can be a pipe extending outward laterally from a side wall (125). At one end of inlet port (140) is a coupling (142) for attachment to a cleaning fluid source (143) (depicted in FIG. 4). The cleaning fluid source (143) can be a garden water hose. At the opposite end of inlet port (140) is a coupling (142) depicted as threaded female connections. Coupling (142) is for attachment to the pivoting sprayer (160) and to each stationary sprayer (150, 151). Coupling (142) can be threaded female connections.

Figure 3:
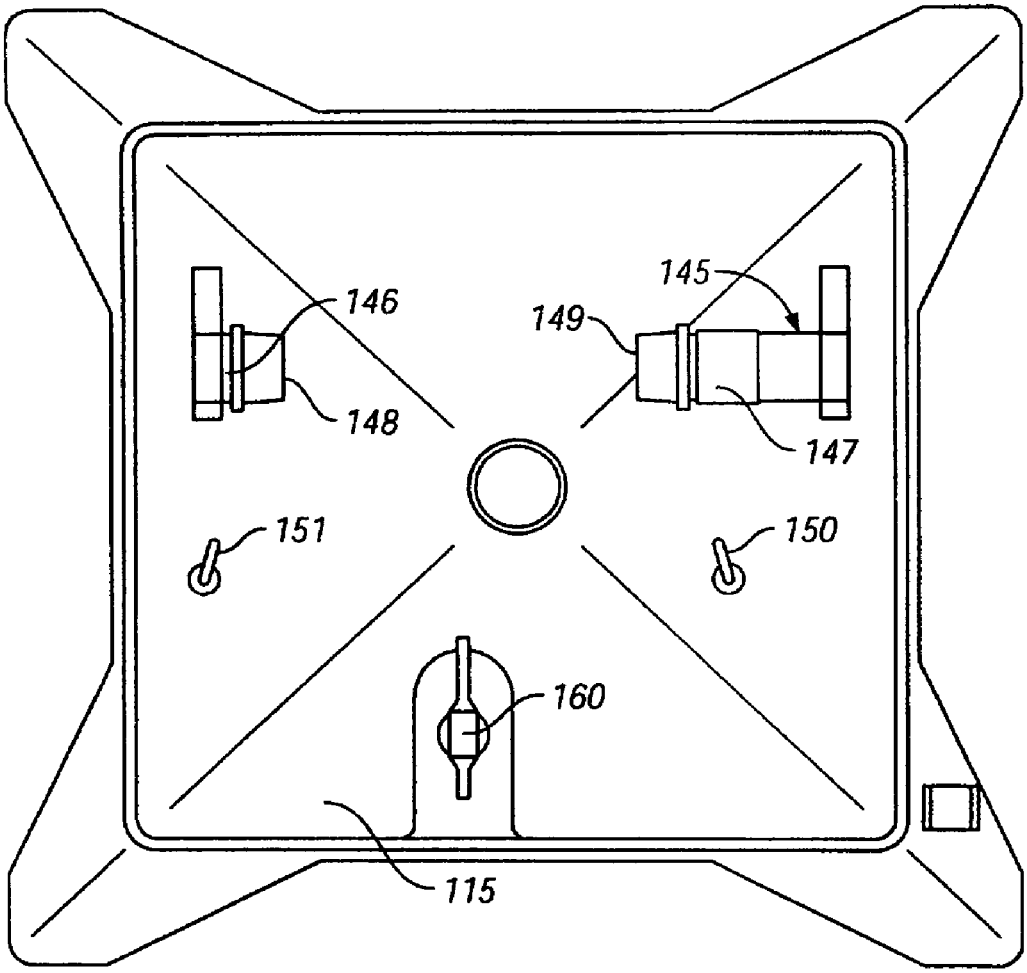
FIG. 3 illustrates a top view of the present invention.
Figure 6:
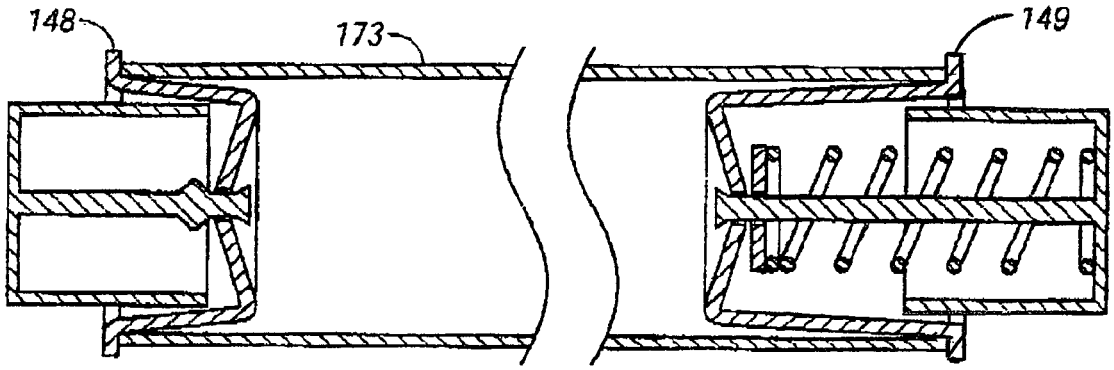
FIG. 6 illustrates an exploded view of the spindle.

Referring to FIG. 3, the illustrated embodiment further includes spindle (145) for holding a soiled paint roller during the cleaning process. Spindle (145) is interiorly mounted approximately near the center of bottom wall (115). As shown, the preferred embodiment of spindle (145) has two support members (146, 147) that extend vertically upward to a predetermined height. The distance between support members (146, 147) is equivalent to the length of a paint roller nap. Each support member (146, 147) have a cylindrical shape stud (148, 149) extending perpendicularly inward therefrom. Each stud (148, 149) has a slightly smaller circumference which is adapted to engage each opened end of a soiled paint roller. In use, while in a horizontal position, each opened end of the soiled paint roller is engaged upon stud (148, 149). Support member (146 or 147) can be spring loaded to allow for the easy insertion and removal of the paint roller (173) as shown in FIG. 6.

Referring back to FIG. 3, at a set height and a distance from spindle (145), stationary sprayers (150, 151) are mounted to the bottom of wall (115). The distance and height from the spindle (145) places each sprayer (150, 151) parallel to the plane of the paint roller. Placement of each sprayer (150, 151) at a parallel plane provides sufficient centrifugal force to turn the roller upon the spindle (145). In use, the stationary sprayers (150, 151) provide a continuous stream of water to clean each opposite end of the soiled paint roller.

The illustrated embodiment in FIG. 3 further includes a pivoting sprayer (160) interiorly mounted to bottom wall (115) at a set distance and height from spindle (145). The distance and height from spindle (145) place pivoting sprayer (160) parallel to the plane of the paint roller. Placement of pivoting sprayer (160) at a parallel plane provides sufficient centrifugal force to turn the roller upon the spindle (145). In use, pivoting sprayer (160) is set to an angle that spans the entire paint roller. Thus, the set angle allows the pivoting sprayer (160) to provide a continuous stream of water to clean the entire the soiled paint roller. The pivoting angle of sprayer (160) can be adjustable.

Referring to FIG. 1, the illustrated embodiment further includes at least one first hooking mechanism (170) externally mounted to side wall (125). Each mounted first hooking mechanism (170) is adapted to engage a hole in the handle of the paint brush. (not shown) Thus, after the paint brush is cleaned, the paint brush can be hung and suspended freely for drying upon the first hooking mechanism (170). Each mounted first hooking mechanism (170) can be a conventional hook and be made of metal, plastic or another suitable material.

The illustrated embodiment further includes at least one second hooking mechanism (165) externally mounted a side wall (125). Each mounted second hooking mechanism (165) is adapted to engage the bottom side of a conventional paint pan (not shown) allowing the paint pan to be hanged, cleaned and suspended freely for drying. Second hook mechanism (165) can be a conventional linear hook having a length sufficient to fit under the bottom side of the paint pan. Each mounted second hooking mechanism (165) can be made of metal, plastic or another suitable material.

The present invention further includes a control valve (153) operationally connected to the inlet port. The control valve (153) allows the operator to selectively initiate and terminate the flow of cleaning fluid between the two stationary sprayers (150, 151) and the pivoting sprayer (160). As depicted the control valve (153) is a manual switch that allows the operator to switch between, an on/off position, stationary sprayer (150, 151) or pivoting sprayer (160).

Figure 4:
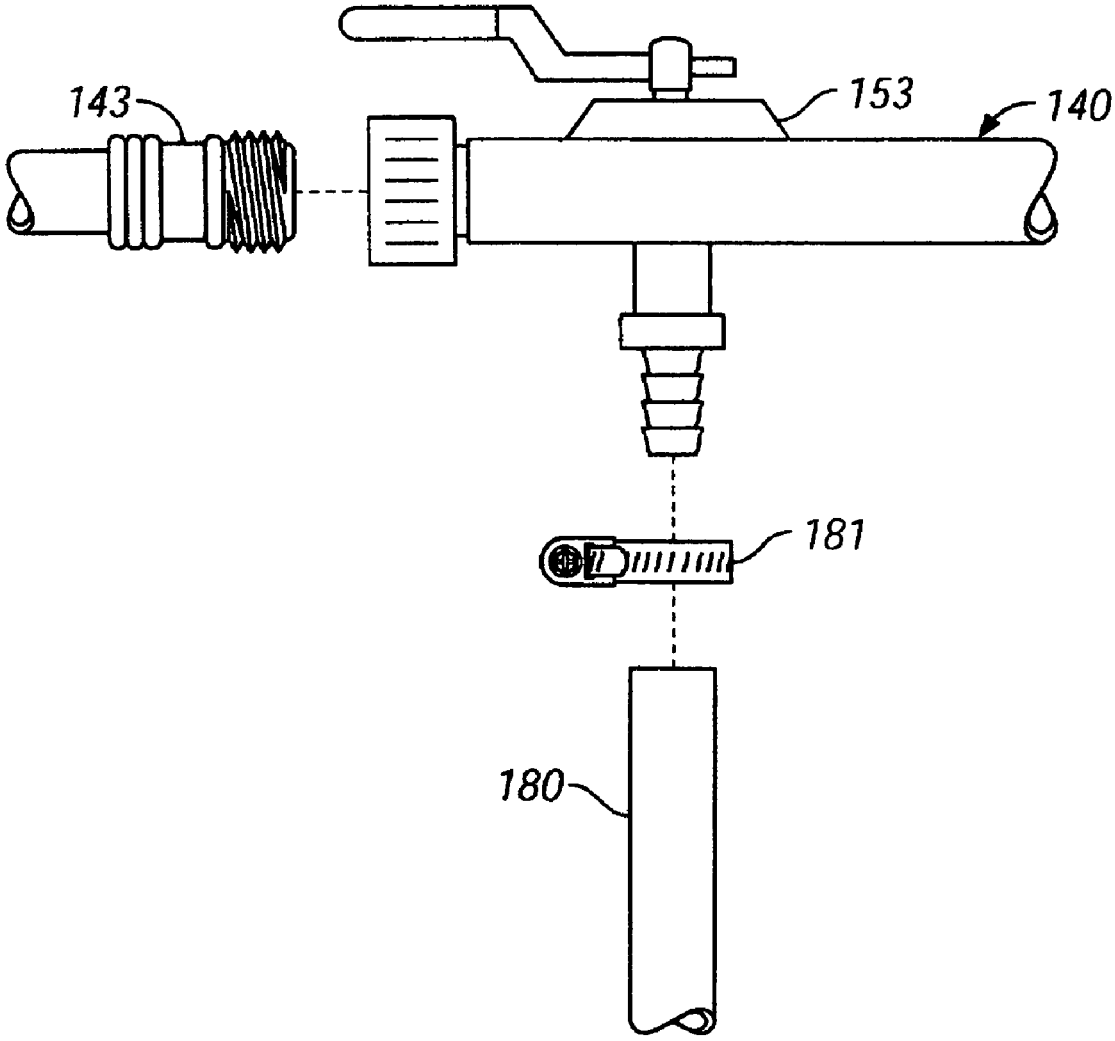
FIG. 4 illustrates an exploded view of the hose connection to the control valve.

As shown in FIG. 4, the present invention can include sprayer nozzle (180) operationally coupled to inlet port (140) utilizing a hose connection (181). Additionally, the control valve (153) works independently of the sprayer nozzle (180). Sprayer nozzle (180) allows the operator to clean the paint brush and paint pan. As depicted in FIG. 1, each cleaned paint brush can be hung on first hooking mechanism (170) and each cleaned paint pan can be hung on second hooking mechanism (165).

In use, referring to FIG. 2, the soiled roller is placed upon spindle (145) in housing (100). Inlet port is connected to the garden water hose. Control valve (153) is turned to allow the pivoting sprayer (160) to provide a continuous stream of water onto the soiled paint roller. Then, the control valve (153) is turned to allow the stationary sprayer (150, 151) to provide a continuous stream of water onto the soiled paint roller. The control valve (153) can be alternated between each sprayer position until the soiled roller is cleaned. The main advantage of this device is to clean the soiled paint roller in a relatively small amount of time, i.e. approximately one minute.

Figure 5:
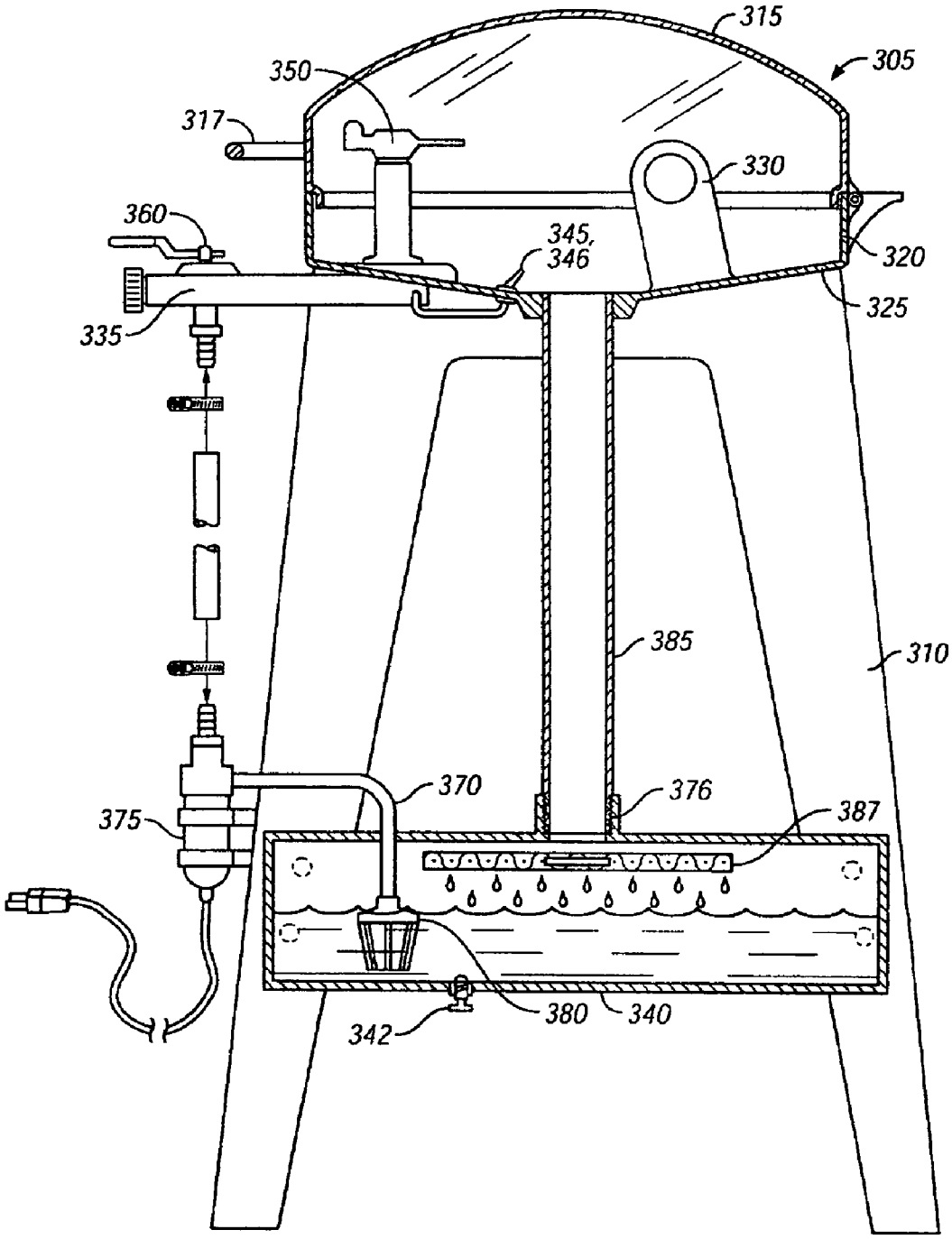
FIG. 5 illustrates an alternative embodiment of the present invention.

Referring to FIG. 5, there is shown an alternative embodiment of the present invention, a device (300) for cleaning a soiled paint roller. This alternative embodiment specifically support paint rollers utilizing oil based paint. The device (300) comprises housing (305) supported by at least two leg members. In this embodiment, housing (305) is supported by four leg members (310). Housing (305) has an opened top with cover (315), a plurality of sidewalls (320) and a bottom wall (325). Handle (317) allows cover (315) to traverse between an opened and closed position. Spindle (330) is interiorly mounted to the bottom wall (325) of the housing (305) at a predetermined height. Spindle (330) has means for circumferentially engaging a paint roller (not shown). An inlet port (335) mounted to a side wall (320) and in fluid communication with a reservoir (340) containing a cleaning solvent. The cleaning solvent can be mineral spirit or another suitable cleaning fluid.

Figure 5A:
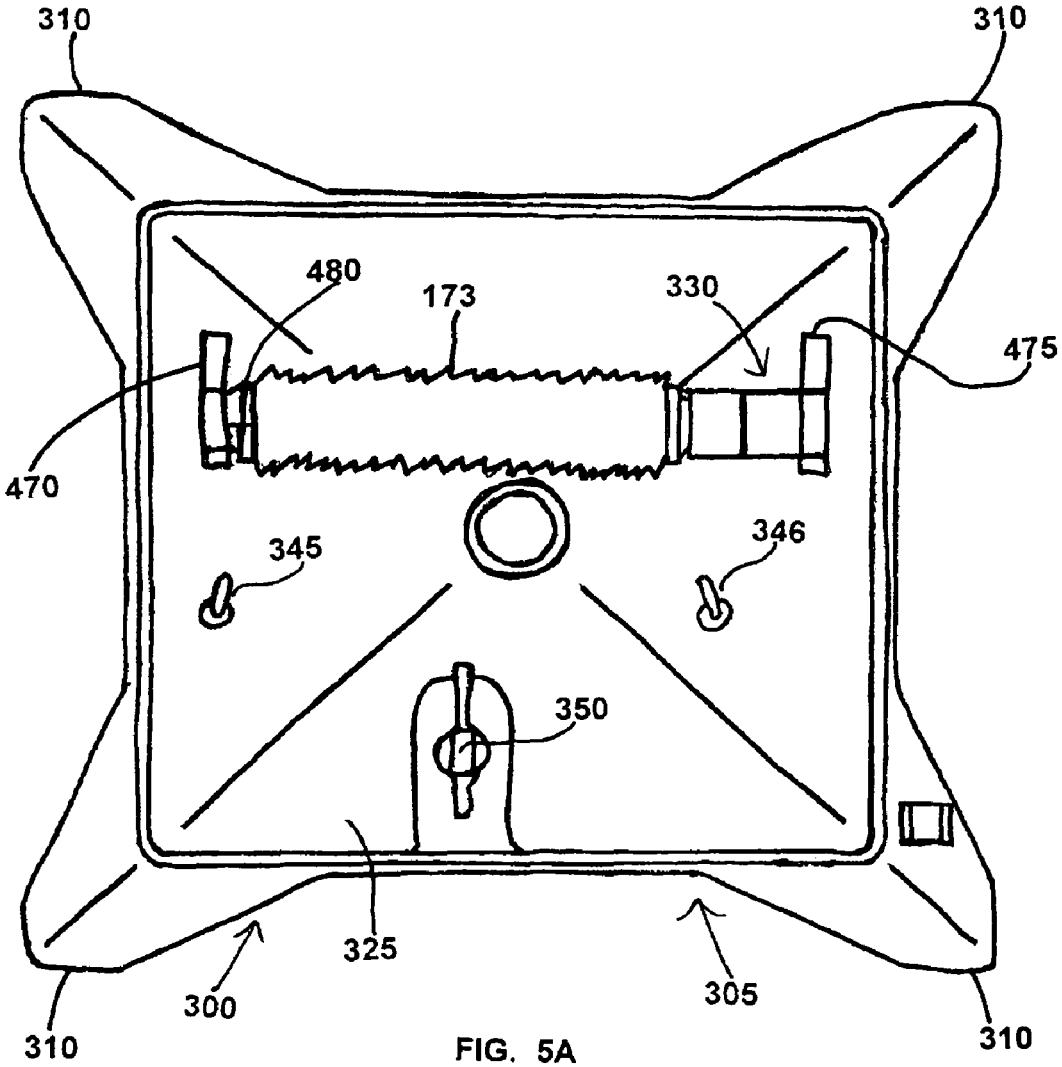

Referring to FIG. 5A, the illustrated embodiment further includes spindle (330) for holding a soiled paint roller during the cleaning process. Spindle (330) is interiorly mounted approximately near the center of bottom wall (325). As shown, the preferred embodiment of spindle (330) has two support members (470, 475) that extend vertically upward to a predetermined height. The distance between support members (470, 475) is equivalent to the length of a paint roller nap. Each support member (470, 475) have a cylindrical shape stud (480, 485) extending perpendicularly inward therefrom. Each stud (480, 485) has a slightly smaller circumference which is adapted to engage each opened end of a soiled paint roller. In use, while in a horizontal position, each opened end of the soiled paint roller is engaged upon stud (480, 485). Support member (470, 475) can be spring loaded to allow for the easy insertion and removal of the paint roller (173) as shown in FIG. 6.

Referring back to FIG. 5, the illustrated embodiment further comprises two stationary sprayers (345, 346) interiorly mounted to the bottom wall (325) at a predetermined height and a predetermined distance from each end of the spindle (330). Each stationary sprayer (345, 346) is in fluid communication with the inlet port (335) for providing a continuous stream of solvent directly onto the soiled paint roller. Pivoting sprayer (350) is interiorly mounted to the bottom wall (325) of housing (305) at a predetermined height and a predetermined distance. In the illustrated embodiment, pivoting sprayer (350) is mounted approximately near the middle of the spindle (330). Pivoting sprayer (350) is in fluid communication with the inlet port (335) shown in FIG. 5 for providing a continuous stream of solvent directly onto paint roller (173). Referring to FIG. 5A, control valve (360) is operationally connected to the inlet port (335). Control valve (360) allows the operator to selectively initiate and terminate the flow of cleaning fluid between the stationary sprayer (345, 346) and the pivoting sprayer (350).

In this embodiment, reservoir (340) further comprises an outlet port (370) and an inlet port (376). The outlet port (370) is coupled to a conventional fluid pump (375). Pump (375) is adapted with sufficient PSI to achieve the centrifugal force required to rotate the paint roller on spindle (330). Pump (375) is in fluid communication with the inlet port (335) of the housing (305) and continuously provides cleaning fluid into the housing (305) from the reservoir (340). First filter (380) is operationally coupled to the pump (375) for the final purification of the cleaning fluid prior to being pump up to housing (305). The first filter (380) can preferable be a micro-bacterial filter. Inlet port (376) is coupled to drain hole (385) and second filter (387). During the cleaning process, second filter (387) is for the purification of the cleaning fluid as it escapes through the drain hole (385) into reservoir (340), thereby allowing the reuse of the cleaning fluid stored in reservoir (340). Second filter (387) can preferable be a debris catching type of filter. Additionally, reservoir (340) can include drain spout (342) for draining the cleaning fluid from reservoir (340).

What is claimed is:

1. An apparatus for cleaning a soiled paint roller, the device comprising:

a housing supported by at least two leg members, the housing having an opened top, a plurality of sidewalls and a bottom wall;

a spindle interiorly mounted to the bottom wall of the container at a predetermined height, the spindle adapted to circumferentially engage the paint roller in a horizontal position; an inlet port mounted to a side wall and in fluid communication with a cleaning fluid source;

at least one stationary sprayer interiorly and individually mounted to the bottom wall at a predetermined height and a predetermined distance directly across from an end of the spindle in a parallel relation to the spindle, the at least one stationary sprayer in fluid communication with the inlet port for providing a continuous stream of cleaning fluid directly onto the paint roller;

at least one automatic pivoting sprayer oscillating back and forth horizontally along the latitude of the spindle interiorly and individually mounted to the bottom wall at a predetermined height and a predetermined distance from the spindle wherein the at least one pivoting sprayer is disposed directly across and parallel to a plane of the roller, the at least one pivoting sprayer in fluid communication with the inlet port for providing a continuous stream of cleaning fluid directly onto the paint roller;

as the continuous stream of cleaning fluid strikes the paint roller, the at least one pivoting sprayer pivoting at a predefined angle to cover the entire plane of the roller wherein the at least one stationary sprayer is configured to work in conjunction with the at least one pivoting sprayer to rotate the roller upon the spindle at a speed sufficient to generate centrifugal force while cleaning the roller; and a control valve operationally connected to the inlet port, the control valve for selectively initiating and terminating the flow of cleaning fluid between the at least one stationary sprayer and the at least one pivoting sprayer.

2. The device of claim 1 further comprising a cover positioned over the opened top.

3. The device of claim 2 wherein the cover is hingedly connected to an upper edge of one sidewall such that the cover can traverse between an opened position and a closed position.

4. The device of claim 2 wherein the at least one handle is mounted to the exterior surface of the cover at a strategic location, whereby the handle can be utilized to transverse the cover between an opened and closed position.

5. The device of claim 2 wherein the cover is made of a transparent material.

6. The device of claim 1 further comprising a drain hole within the bottom wall for allowing the escape of fluid from the housing.

7. The device of claim 6 wherein an elongated pipe is coupled to the drain hole and extends vertically downward therefrom.

8. The device of claim 6 further comprising: a drying rack having a flat planar surface with a plurality of cylindrical shape studs extending vertically upward to a predetermined height; each stud having a means for circumferentially engaging an opened end of a paint roller; and the drying rack mounted between the at least two leg members at a predetermined distance below the drain hole such that an opened end of a paint roller can be circumferentially engaged in a vertical position.

9. The device of claim 1 wherein the at least one pivoting sprayer has an adjustable pivoting angle.

10. The device of claim 1 wherein the bottom wall slopes inward at an incline from the outer peripheral edges of the bottom wall to the drain hole.

11. The device of claim 1 further comprising at least one first hooking mechanism externally mounted to a side wall and adapted to engage a hole in the handle of a paint brush.

12. The device of claim 1 further comprising at least one second hooking mechanism externally mounted to a side wall and adapted to engage a bottom side of a paint pan.

13. The device of claim 1 further comprising a sprayer nozzle coupled to the inlet port and in fluid communication with the cleaning fluid source.

14. The device of claim 1 wherein the cleaning fluid source is a garden water hose connection.

15. The device of claim 1 wherein the spindle further comprises:

a pair of support members spaced apart approximately the length of a nap roller;

each support member having an upper end with a cylindrical shape stud extending perpendicular inward therefrom; and the stud adapted to circumferentially engage the nap roller.

16. An apparatus attachable to a hose for cleaning a soiled paint roller, the device comprising: a housing supported by at least two leg members, the housing having an opened top, a plurality of sidewalls and a bottom wall; a spindle interiorly mounted to the bottom wall of the container at a predetermined height, the spindle adapted to circumferentially engage the paint roller in a horizontal position; an inlet port mounted to a side wall and in fluid communication with a reservoir containing a cleaning fluid; at least one stationary sprayer interiorly mounted to the bottom wall at a predetermined height and a predetermined distance directly across from an end of the spindle in a parallel such that each stationary sprayer is in fluid communication with the inlet means for providing a continuous stream of fluid directly onto the paint roller; a pivoting sprayer interiorly mounted to the bottom portion at a predetermined height and a predetermined distance directly across from approximately near the middle of the spindle in a parallel relation to the spindle, the pivoting sprayer in fluid communication with the inlet means for providing a continuous stream of fluid directly onto the paint roller; as the continuous stream of cleaning fluid strikes the paint roller, the at least one pivoting sprayer pivoting at a predefined angle to cover an entire plane of the roller wherein the at least one stationary sprayer is configured to work in conjunction with the at least one pivoting sprayer to rotate the roller upon the spindle at a speed sufficient to generate centrifugal force while cleaning the roller; and a control valve operationally connected to the inlet means, the control valve for selectively initiating and terminating the flow of cleaning fluid between the stationary and the pivoting sprayer.

17. The device of claim 16 wherein the reservoir further comprises: an outlet port and an inlet port; the outlet port coupled to a pump;

the pump in fluid communication with the inlet port of the housing for providing cleaning fluid into the housing from the reservoir; a first filter operationally coupled to the pump for the final purification of the cleaning fluid; and the inlet port of the reservoir being coupled to a drain hole for the collection of excess fluid from the housing; a second filter coupled to the inlet port for the purification of the cleaning fluid as it escapes through the drain hole into the reservoir, thereby allowing the reuse of the cleaning fluid stored in the reservoir.

18. The device of claim 17 wherein the cleaning fluid is mineral spirits.

19. The device of claim 17 wherein the first filter is a micro-bacterial type of filter.

20. The device of claim 17 wherein the second filter is a debris catching type of filter.

21. The device of claim 16 further comprising: a cover positioned over the opened top; and the cover adapted to traverse between an opened and a closed position.

* * * * *